United States Patent [19]

Brighton

[11] Patent Number: 4,899,660

[45] Date of Patent: Feb. 13, 1990

[54] TRAINING ROUND FOR FIREARM

[75] Inventor: Richard W. Brighton, London, Canada

[73] Assignee: Rainier International, Inc., Carson City, Nev.

[21] Appl. No.: 179,680

[22] Filed: Apr. 11, 1988

[51] Int. Cl.[4] ..... F42B 8/00

[52] U.S. Cl. ..... 102/447; 102/430; 102/444; 102/464; 102/502; 102/513; 102/529

[58] Field of Search ..... 102/430, 464–472, 102/444–447, 502, 513, 529, 530; 42/96

[56] References Cited

U.S. PATENT DOCUMENTS

| | | | |
|---|---|---|---|
| H114 | 8/1986 | Quintavalle | 102/513 |
| 490,614 | 1/1893 | Redwine | 102/444 |
| 2,482,436 | 9/1949 | Ream . | |
| 2,539,968 | 1/1951 | Payne . | |
| 2,841,907 | 7/1958 | Nichols . | |
| 2,944,358 | 7/1960 | Weimer . | |
| 3,049,828 | 8/1962 | Mills . | |
| 3,067,680 | 12/1962 | Lahr . | |
| 3,386,381 | 6/1968 | Ferb . | |
| 3,638,571 | 2/1972 | Gawlick et al. | 102/444 |
| 3,650,213 | 3/1972 | Abbott et al. | 102/444 |
| 3,710,720 | 1/1973 | Mawhimny . | |
| 3,782,286 | 1/1974 | Jones et al. | 102/502 |
| 3,820,465 | 6/1974 | Delphia . | |
| 3,857,339 | 12/1974 | Grandy | 102/430 |
| 3,865,038 | 2/1975 | Barr | 102/502 |
| 3,901,158 | 8/1975 | Ferb . | |
| 3,911,824 | 10/1975 | Barr et al. . | |
| 3,952,662 | 4/1976 | Greenlees . | |
| 3,982,489 | 9/1976 | Flatau et al. . | |
| 3,983,817 | 10/1976 | Tucker | 102/444 |
| 3,998,161 | 12/1976 | Booth | 102/464 |
| 4,686,905 | 8/1987 | Szabo | 102/444 |
| 4,691,638 | 8/1987 | Meyer et al. | 102/485 |

FOREIGN PATENT DOCUMENTS

| | | | |
|---|---|---|---|
| 1138341 | 10/1962 | Fed. Rep. of Germany | 102/530 |

*Primary Examiner*—Harold J. Tudor
*Attorney, Agent, or Firm*—Gerald L. Moore

[57] ABSTRACT

A practice round [10] for use in firearms including a casing [11] holding a projectile [16]. A standard primer cap [20] is detonated to propel the projectile forward. A vent hole [40] in the casing limits the pressure buildup in the casing cavity [17].

4 Claims, 1 Drawing Sheet

FIG. 2A
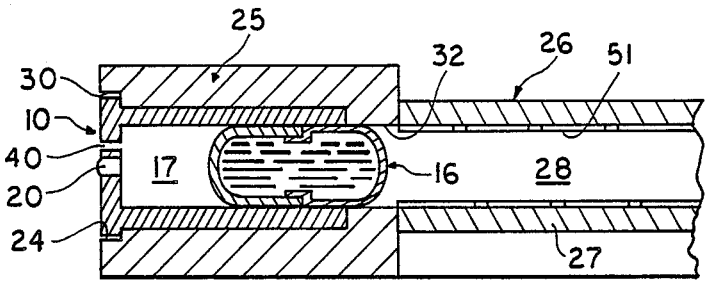
FIG. 2B
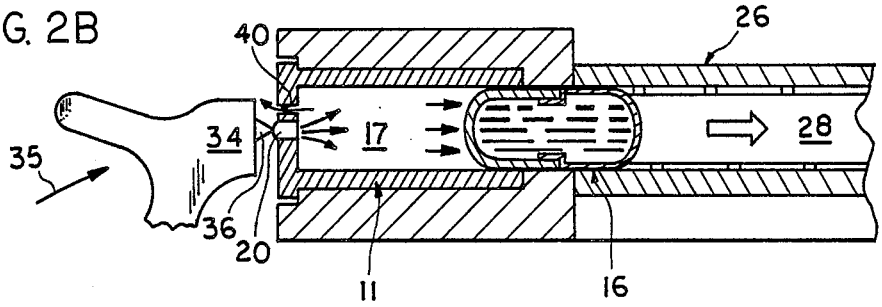
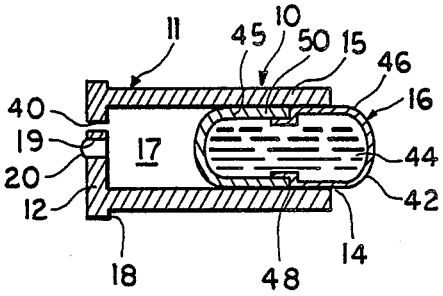
FIG. 1
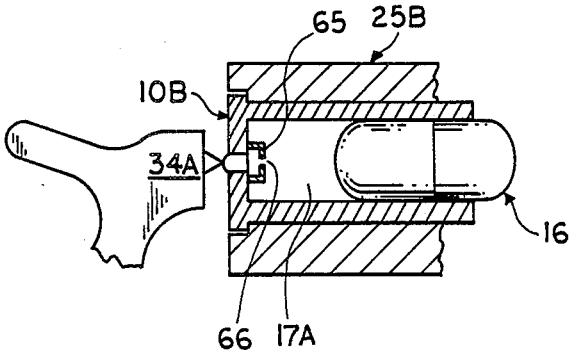
FIG. 4
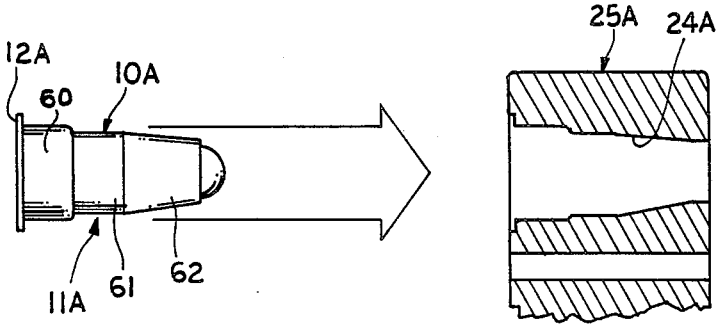
FIG. 3

TRAINING ROUND FOR FIREARM

CROSS REFERENCE TO RELATED APPLICATIONS

This invention relates to a practice round of the general type described in copending U.S. application Ser. No. 179,741 filed on Apr. 11, 1988, with Richard W. Brighton as inventor and entitled Non-Lethal Practice Round for Automatic and Semiautomatic Firearms.

BACKGROUND OF THE INVENTION

1. Field of the Invention

This invention relates to a live practice round for use in revolvers and like firearms which propels a non-lethal projectile to mark the point of impact.

2. Description of the Prior Art

There has existed the need for a realistic and safe practice round to be fired in actual or modified firearms. Primary groups which would use such non-lethal rounds in practice are the military, law enforcement, movie makers and participants in war games. Practice rounds used by the above organizations and others have safety as a primary objective. The ideal round would fire a projectile that would travel a reasonably predictable path, would be non-injurious to any person or thing being struck and would mark the point of impact. Additionally, the round should be adapted for use in standard weapons so as to give the user the actual "feel" for his own firearm while doing away with the cost of buying special weapons for practice. Additionally, the practice round itself should be as inexpensive as possible so as to reduce the overall cost of practicing.

At the present time there are available for practice, blank rounds which fire no projectile and laser guns which fire no projectile but which have the impact point indicated by detectors positioned on the target. The blank or "dummy" rounds are not effective since they give no indication where the user is hitting and the laser guns are expensive, somewhat cumbersome and fail to give the user the actual feel for the weapon he ultimately will use in actual combat or law enforcement situations.

$CO_2$ pistols are also used in practice to propel a ball containing dye at a target. The dye ball breaks on impact to mark the hit. While these weapons indicate whether the target is hit or not, they are somewhat unrealistic since they are specially designed for firing the $CO_2$ propelled ball. Thus while a projectile is fired and the point of impact is indicated, still there remains much to be desired in training an individual in as near a real situation as possible.

It is the purpose of the present invention to provide a practice round of the non-lethal type which can be used with either unmodified or slightly modified firearms to propel a projectile capable of marking the point of impact with such rounds being reasonably inexpensive and having a sufficiently low muzzle velocity so as to significantly reduce chance of injury if a person is struck at close range.

SUMMARY OF THE INVENTION

A non-lethal training round for use in a revolver or similar firearm or the like and having a rigid casing with walls forming a cavity and including an opening for receiving and holding a non-lethal projectile. A primer cap is in the casing in position to be detonated by a firing pin or otherwise energized and propel the projectile out the barrel. To allow the use of standard primer caps, at least one vent hole is formed in the casing to limit pressure buildup within the casing and regulate the muzzle velocity of the projectile.

DESCRIPTION OF THE DRAWINGS

FIG. 1 is a cross sectional view of a non-lethal training round made in accordance with the present invention;

FIGS. 2A and 2B are cross sectional views of the round in a chamber of a firearm;

FIG. 3 shows a round and firearm chamber of a second embodiment of the invention; and FIG. 4 shows a third embodiment of the invention.

DESCRIPTION OF PREFERRED EMBODIMENTS OF THE INVENTION

In FIG. 1 the non-lethal round 10 is shown configured in a manner to allow use in a conventional firearm, a portion of which is shown in FIGS. 2A and 2B. A rigid casing 11 is illustrated having a cylindrical wall section 15, an end wall 12 and an opening 14 positioned opposite the end wall through which a projectile 16 is inserted. The end wall 12 is extended past the cylindrical section to form a flange 18. The end wall also includes an opening 19 in which a primer cap 20 is inserted. Preferably, this primer cap is a standard make and size commonly used in standard lethal rounds.

In this instance the primer cap 20 is positioned in the center of the end wall 12 thereby requiring a center-fire firearm for use of this round. Thus, as shown in FIGS. 2A and 2B, the round 10 can be loaded into the chamber 24 of a receiver 25 of a suitable weapon for firing the caliber of round shown in the drawings. The receiver abuts a barrel 26 having sidewalls 27 forming the barrel passage 28. The receiver can be a partial cross section of a revolver cylinder or other similar weapon having a receiver abutting the barrel in the manner shown. The receiver forms the chamber 24 with the inset area 30 for accommodating the flange 18 which positions the round longitudinally in the chamber. As illustrated, the chamber narrows down to form the opening 32 positioned adjacent the barrel passage 28 and of the same size so as to initiate passage of the projectile 16 into the barrel opening.

As shown in FIG. 2B, when it is desired to discharge the round 10 a hammer 34 is pivoted in the direction of the arrow 35 to bring the firing pin 36 into contact with the primer cap 20. This results in the detonation of the firing cap resulting in the expelling of hot expanding gases into the chamber 17 between the projectile 16 and the end wall 12. The hot gases exert a force proportional to the gas pressure to propel the projectile from the casing 11 and out through the barrel 26.

In accordance with one feature of the invention there is formed within the casing 11 and in the end wall 12 one or more vent holes 40 for allowing a predetermined discharge of the detonation gases from the chamber 17 as the round is fired. In this manner means are provided to limit the maximum pressure within the cavity 17 thereby limiting the overall force exerted on the projectile to control the muzzle velocity thereof. The use of the vent hole or holes thereby allows the incorporation of a standard primer cap in the round for purposes of economy, but limits the amount of force generated in the cavity to control the force exerted on the casing and on the projectile. Of course, if the pressure from the primer cap exceeds the maximum pressure desired in the round upon firing, the vent hole can either be made larger or more vent holes can be located in the casing.

Additionally it is thought that the vent hole limits the rate of buildup of pressure within the casing cavity, thereby limiting the initial shock force to which the projectile is subjected. This allows for use of less structurally rigid projectiles making the practice round safer.

In this instance, the vent holes 40 are shown in the end wall 12 of the round 10 but in some instances with proper modification of the chamber 24, the vent holes can be positioned in other areas of the casing. The primary purpose of reducing the overall maximum pressure in the chamber 17 is to reduce the force exerted on the projectile and limit the muzzle velocity of the projectile. In non-lethal practice rounds it is desirable to limit the muzzle velocity of the projectile to reduce the chance of injury at close range. Additionally, in certain practice rounds such as those filled with a vegetable dye or other material used to mark the point of impact, the lower pressure exerted on the projectile is desirable to protect the integrity of the projectile until it strikes the target. In other words, higher pressure exerted on the projectile may cause it to rupture within the weapon or before reaching the target. Any attempt at making the projectile stronger to withstand higher forces can result in making the round sufficiently strong to penetrate a target rather than merely marking it.

In accordance with another feature of the invention a particular projectile is disclosed suitable for use with the non-lethal practice round described heretofore. In this instance, the projectile 16 comprises a capsule 42 forming an inner cavity 44 containing a liquid such as a vegetable dye for marking the point of impact of the projectile or a disabling substance. The capsule is formed of a rear section 45 and a forward section 46 preferably made of semi-rigid material such as plastic formed of two sections and joined at a joint 48. In this instance, the forward section 42 fits under a rearward section 45 at the joint and can be sealed to better contain the dye material. The rearward section 45 is formed of a thicker material so as to better withstand the forces within the chamber 17 that propel the projectile from the firearm. The forward section 46 is formed of a thinner material or can be scored to permit better and easier fragmentation when an object is struck by the projectile thereby permitting release of the dye or other substance. If desired, the outer walls 50 of the projectile can be made thicker also to withstand the deformation or cutting of riflings 51 in the barrel 26 of the weapon, which riflings will cause the projectile to rotate about the longitudinal axis for better accuracy.

Thus, it can be seen that the present invention provides a nonlethal practice round which can be used in standard weapons to permit the user to practice without harm to a target. By limiting the muzzle velocity, various types or projectiles can be utilized and the rounds will not penetrate another person even at close range. However the user is afforded the opportunity of utilizing his own firearm while practicing with the obvious advantages of gaining confidence and accuracy in such usage. By use of the vent holes 40 to limit the muzzle velocity of the projectile, standard primer caps can be incorporated with the obvious economies of manufacture. Additionally, the limitation of the pressure within the casing permits use of rigid plastic casings with further economic gains. As different muzzle velocities are desired, the size of the vent holes need only be changed and in some instances, other standard types of primer caps used to meet the particular specifications.

It should also be understood that wherein only one capsule has been described for use with each casing, multiple capsules or projectiles can be used with similar beneficial results. For instance, shotgun type shells (not shown) can be provided with vent holes and multiple capsules and function much in the same manner as heretofore described with respect to the previous embodiment.

In accordance with another feature of the invention, a second embodiment of the invention is shown in FIG. 3. Herein a practice round 10A is shown for use in a receiver 25A. One factor affecting safety in the use of the practice round shown in FIG. 1 is the possibility of accidentally inserting a live round (not shown) in place of the obviously safe practice round. Even though the practice rounds can be made of different materials and distinctive colors, the possibility of accidentally interchanging rounds still remains because the rounds function in the same chamber. To alleviate this problem the round 10A is provided having a casing 11A formed of sections 60, 61 and 62 joined together with an end wall 12A. By making the sections 60, 61 and 62 of differing diameters and tapered form, and by use of the receiver 25A having a chamber 24A formed to receive the round shown in FIG. 3A, the possibility of inserting a standard live round is alleviated. In many weapons suitable for firing the herein described non-lethal round, such as revolvers, the cylinders can be easily exchanged. Thus, it is anticipated that an additional cylinder be provided, possibly of a different color and made of plastic material which can be quickly and inexpensively inserted in place of a standard cylinder to prevent the accidental insertion and firing of a live round in the weapon. The interworkings of the round 10A are identical to that described in the previous embodiment.

Another embodiment of the invention (not shown) involves the use of a sleeve to modify the standard cylinder of a conventional weapon. The sleeve has an outer configuration conforming to the chamber of a conventional revolver cylinder, for instance, but has formed therein an unconventional chamber such as that shown in FIG. 3. This embodiment permits the use of a conventional firearm to fire the subject practice rounds but prevents the insertion of standard lethal rounds that will not fit into the sleeve chamber.

In FIG. 4 is shown another means for limiting the rate of buildup of pressure within the cavity 17A of a receiver 25B. In this embodiment the round 10B includes the cavity holding the projectile 16. A primer cap 20 is provided for causing a gas pressure rise in the cavity to propel the projectile. As means to limit the rate of pressure buildup in the cavity 17A, a wall member 65 encloses the cap and includes an opening 66 limiting the rate of passage of gas under pressure from the primer cap to the cavity.

I claim:

1. A non-lethal training round for use in a revolver type weapon comprising:

a non-lethal projectile;

a casing having walls forming a cavity to receive said projectile, said casing having a first opening in a first wall to allow exiting of said projectile and having a second wall forming an end wall;

a primer cap in said end wall communicating with said cavity and energizeable as the sale source to cause a gas pressure increase in said cavity and drive said projectile from said casing out through said first opening; and said casing walls including means to limit the pressure buildup in said cavity to thereby limit the force exerted on said projectile including at least one vent opening in said end wall communicating with said cavity.

2. A non-lethal training round as defined in claim 1, wherein said non-lethal projectile comprises a capsule having walls forming a second cavity filled with a material.

3. A non-lethal training round as defined in claim 2, wherein said capsule has forward rear walls aligned to face said first and second walls respectively of said casing and wherein said rear wall faces said casing cavity and is reinforced to withstand the force of the gas pressure within said casing cavity.

4. A non-lethal training round as defined in claim 3, wherein said forward wall of said capsule is weaker than said rear wall to allow the capsule to rupture when it hits a target.

* * * * *